US011085466B2

(12) United States Patent
Orth et al.

(10) Patent No.: US 11,085,466 B2
(45) Date of Patent: Aug. 10, 2021

(54) ELECTROHYDRAULIC SYSTEM FOR USE UNDER WATER, COMPRISING AN ELECTROHYDRAULIC ACTUATOR

(71) Applicant: Robert Bosch GmbH, Stuttgart (DE)

(72) Inventors: Alexandre Orth, Waldbuettelbrunn (DE); Gottfried Hendrix, Gemuenden (DE); Markus Junker, Kleinostheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/604,888

(22) PCT Filed: Mar. 26, 2018

(86) PCT No.: PCT/EP2018/057571
§ 371 (c)(1),
(2) Date: Oct. 11, 2019

(87) PCT Pub. No.: WO2018/192747
PCT Pub. Date: Oct. 25, 2018

(65) Prior Publication Data

US 2020/0158140 A1 May 21, 2020

(30) Foreign Application Priority Data

Apr. 18, 2017 (DE) ..... 10 2017 206 506.0

(51) Int. Cl.
*F15B 15/18* (2006.01)
*E21B 33/035* (2006.01)
(Continued)

(52) U.S. Cl.
CPC ..... *F15B 15/18* (2013.01); *E21B 33/0355* (2013.01); *E21B 34/04* (2013.01);
(Continued)

(58) Field of Classification Search
CPC ..... E21B 33/0355; E21B 34/04; F15B 1/021; F15B 15/1461; F15B 15/1471; F15B 15/18; F15B 15/226; F15B 15/228; F15B 21/066
See application file for complete search history.

(56) References Cited

U.S. PATENT DOCUMENTS 3,120,103 A * 2/1964 Beard ..... F15B 15/18 60/406
3,572,032 A * 3/1971 Terry ..... E21B 33/0355 60/398

(Continued)

FOREIGN PATENT DOCUMENTS

DE 10 2015 213 695 A1 2/2016
WO 95/22026 A1 8/1995

OTHER PUBLICATIONS

International Search Report corresponding to PCT Application No. PCT/EP2018/057571, dated Jul. 6, 2018 (German and English language document) (5 pages).

*Primary Examiner* — F Daniel Lopez
*Assistant Examiner* — Matthew Wiblin
(74) *Attorney, Agent, or Firm* — Maginot, Moore & Beck LLP

(57) ABSTRACT

An electrohydraulic system for use under water includes an electrohydraulic actuator and a container having an internal space provided for forming a volume which is enclosed from the environment and which is provided for receiving a hydraulic pressurized fluid. A hydraulic cylinder is provided in the internal space of the container, the inside of which is divided into a first cylinder chamber and a second cylinder chamber by a piston to which a first piston rod and a second piston rod are connected. The two active surfaces of the piston are the same or approximately the same size.

11 Claims, 4 Drawing Sheets

(51) Int. Cl.

| | |
|---|---|
| ***E21B 34/04*** | (2006.01) |
| ***F15B 15/14*** | (2006.01) |
| ***F15B 15/22*** | (2006.01) |
| *F15B 1/26* | (2006.01) |

(52) U.S. Cl.
CPC ..... *F15B 15/1471* (2013.01); *F15B 15/226* (2013.01); *F15B 1/265* (2013.01); *F15B 2201/3156* (2013.01); *F15B 2201/4053* (2013.01)

(56) References Cited

U.S. PATENT DOCUMENTS 4,500,066 A * 2/1985 Trassl ..... F15B 15/18 251/26
4,612,983 A * 9/1986 Karr, Jr. ..... E21B 29/04 166/55
5,501,424 A * 3/1996 Williams ..... F16K 3/0227 251/1.3
9,967,500 B2 * 5/2018 Ovsiannikov ..... H04N 5/378
2005/0022523 A1 * 2/2005 Nagai ..... F15B 15/18 60/473
2006/0260464 A1 * 11/2006 Sato ..... B24B 19/06 92/88
2008/0245432 A1 * 10/2008 Lenz ..... E21B 33/0355 138/30
2008/0264646 A1 * 10/2008 Sten-Halvorsen ..... E21B 33/0355 166/360
2014/0014356 A1 * 1/2014 Herland ..... E21B 33/064 166/368
2014/0326459 A1 * 11/2014 Landrith, II ..... E21B 34/02 166/335
2016/0245425 A1 * 8/2016 Heyn ..... E21B 33/0355

* cited by examiner

ELECTROHYDRAULIC SYSTEM FOR USE UNDER WATER, COMPRISING AN ELECTROHYDRAULIC ACTUATOR

This application is a 35 U.S.C. § 371 National Stage Application of PCT/EP2018/057571, filed on Mar. 26, 2018, which claims the benefit of priority to Serial No. DE 10 2017 206 506.0, filed on Apr. 18, 2017 in Germany, the disclosures of which are incorporated herein by reference in their entirety.

The present disclosure relates to an electrohydraulic system for use under water, in particular at great water depths, having an electrohydraulic actuating drive. The electrohydraulic actuating drive serves in particular for the actuation of underwater actuators. The system comprises a container, which has an inner space provided for forming a volume which is sealed off with respect to the surroundings and which is provided for receiving a hydraulic pressurized fluid. The system furthermore comprises a hydraulic cylinder which is arranged in the inner space of the container.

BACKGROUND

Electrohydraulic systems of such type may be used to move an element under water at water depths of up to several thousand meters in connection with the conveyance of crude oil and natural gas, with mining, scientific investigations or infrastructure projects. In this regard, for example in crude oil- or natural gas-conveying installations, process valves by which the volume flow of the medium to be conveyed can be regulated or blocked are situated at sea at great depths.

An electrohydraulic system may comprise a hydraulic cylinder whose cylinder housing is seated on the housing of a process valve and which comprises a piston and a piston rod projecting away from the piston on one side, via which piston rod a process valve slide of the process valve is able to be moved. The piston divides the interior of the cylinder housing into a cylinder space which is remote from the piston rod and into a piston rod-side cylinder space. A mechanical spring arrangement, for example helical compression spring, which acts on the piston in the sense of a closure process valve, is accommodated in the piston rod-side cylinder space. When such a differential cylinder is retracted and extended, it is normally the case that there is a displacement or requirement of oil that corresponds to the volume of the cylinder rod (rod area times traversing distance). A disadvantage of this arrangement is that, during each cylinder movement (both toward the inside and toward the outside), a change of the hydraulic volume occurs. Moreover, it is problematic that each machine cycle also forms a stress cycle in relation to the diaphragm of a pressure compensator, which considerably impairs the operating duration for applications over many years under water.

SUMMARY

Taking this as a starting point, it is an object of the present disclosure to provide an electrohydraulic system and a device which alleviate or even avoid the stated disadvantages. In particular, the intention is for oscillating volumes to be generated as little as possible in the container of the actuating drive in a constructively simple manner. It is furthermore intended that the operating duration is significantly increased.

Said objects are achieved by an electrohydraulic system, and by a device, as disclosed herein. It should be noted that the description, in particular in conjunction with the figures, sets out further details and refinements of the disclosure which are able to be combined with other features disclosed herein.

This is contributed to by an electrohydraulic system for use under water, having an electrohydraulic actuating drive and having a container, which container has an inner space provided for forming a volume which is sealed off with respect to the surroundings and which is provided for receiving a hydraulic pressurized fluid. A hydraulic cylinder is present in the inner space of the container, the interior of which hydraulic cylinder is subdivided by a piston, to which a first piston rod and a second piston rod are connected, into a first cylinder chamber and into a second cylinder chamber, wherein the two active surfaces of the piston are (approximately or exactly) the same size.

The electrohydraulic system proposed here has the particular advantage that the double-acting hydraulic cylinder (synchronous cylinder) minimizes the change of the fluid volume in the cylinder housing (oscillating volume) when the (hydraulic or mechanical) cylinder is moved out or retracted. The internal fluid may be a hydraulic fluid, a mechanical fatty substance or a transformer oil. Furthermore, undesired stresses or changes in stress on the diaphragm of the pressure compensator are avoided.

Preferably, for the purpose of compensating for the volume flow of the hydraulic cylinder to be actuated, an additional cylinder chamber, which is subjected to vacuum or negative pressure, is present. The cylinder chamber may be equipped with a circuit arrangement and/or lines, and/or be connected thereto, which can set a vacuum/negative pressure in the cylinder chamber. In particular, the additional cylinder chamber is equipped with corresponding line connections.

The additional cylinder chamber is advantageously associated with the second piston rod. This may mean that the additional cylinder chamber is formed, or delimited, at least partially by the second piston rod. In particular, it is possible for a volume of the additional cylinder chamber to be variable by means of the second piston rod.

The additional cylinder chamber is expediently a vacuum bushing or a vacuum sleeve. It is possible for the additional cylinder chamber to be designed as a separate component.

The additional cylinder chamber is preferably assigned a check valve.

Preferably, the second piston rod is arranged so as to remain, at least substantially, in the cylinder housing of the hydraulic cylinder. This means in particular that, even in the case of a planned or configured movement of the second piston rod, the latter is substantially or even completely enclosed or accommodated by the cylinder housing of the hydraulic cylinder.

The piston is advantageously assigned at least one position sensor. A position sensor is configured in particular for determining the present position of a component of the piston.

Furthermore, an additional cylinder housing is preferably arranged between the hydraulic cylinder and the process valve housing, wherein a pressure piston subdivides the interior of the cylinder housing into a first cylinder chamber and into a second cylinder chamber. The pressure piston is advantageously mounted slidingly on the first piston rod. Preferably, within the second housing chamber, a carrier element, for example a stop, shoulder, annular flange or the like, is fastened to the first piston rod and allows form-fitting engagement with the pressure piston. The engagement between the first piston rod and the pressure piston may also be realized in a force-fitting manner. Expediently, a compression spring in the first housing chamber is supported at one side against the pressure piston and at the other side against the first housing chamber or the process valve housing.

It is furthermore preferable for a pressure compensator to be present, in order to subject the hydraulic pressurized fluid in the inner space at least approximately to the pressure which prevails in the surrounding seawater region. The pressure compensator is advantageously a diaphragm accumulator or a bladder accumulator.

A check valve is expediently fitted in the additional cylinder chamber.

Preferably, a 2/2 directional seat valve, with an electromagnet and a spring, is inserted into the connection between the hydraulic machine and the second cylinder chamber.

Proposed according to a further aspect is a device for arranging under water, and for controlling, a conveyable volume flow of a gaseous or liquid medium, having a process valve which has a process valve housing, having a process valve slide by way of which the volume flow is able to be controlled, and having a hydraulic cylinder which is associated with the process valve housing and is movable with the process valve slide, characterized by an electrohydraulic system having an electrohydraulic actuating drive, wherein the first piston rod is connected to the process valve slide. The electrohydraulic actuating drive actuates an underwater actuator.

BRIEF DESCRIPTION OF THE DRAWINGS

The disclosure and the technical field will be explained in more detail below on the basis of figures. Here, identical components are denoted by the same reference signs. The illustrations are schematic and are not intended for illustrating size ratios. The explanations given with reference to individual details of a figure are able to be extracted and freely combined with information from other figures or the aforementioned description unless, for a person skilled in the art, something else necessarily results or such a combination is explicitly prohibited here. In the figures, schematically.

DETAILED DESCRIPTION

The exemplary embodiments, shown in the figures, of an electrohydraulic system according to the disclosure have a process valve 1 with a process valve housing 2 through which a process valve duct 3 runs, which process valve duct is continued at its mouths by tubes (not illustrated) and in which process valve duct a gaseous or liquid medium flows from the seabed to a part of a drilling rig that projects from the sea, or to a drilling ship. The flow direction is to be indicated by the arrow 4.

Figure 1:
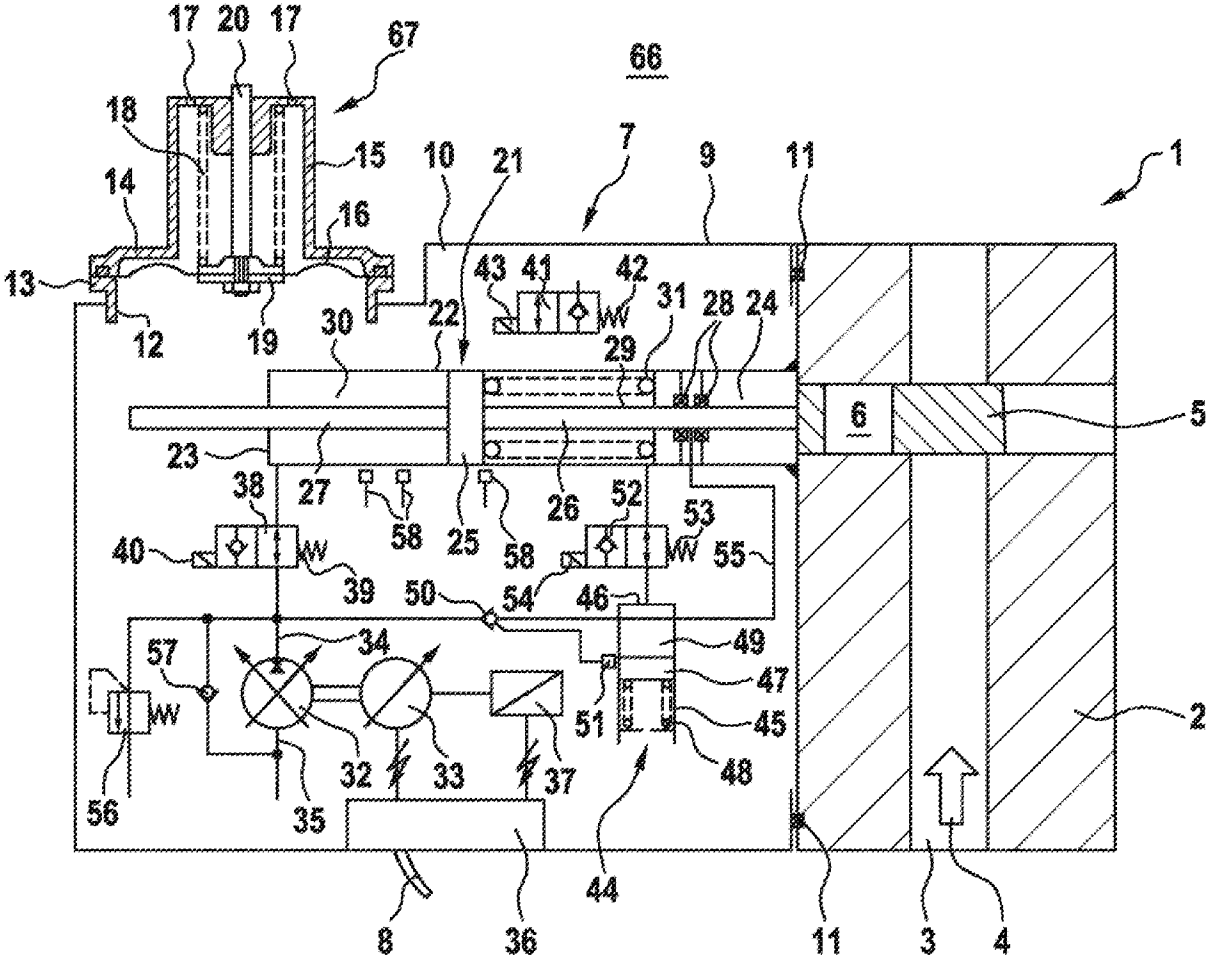
FIG. 1 shows a side view of the device with closed process valve.

Formed in the process valve housing 2 as per FIG. 1 is a cavity which traverses the process valve duct 3 and in which a process valve slide 5 having a throughflow opening 6 is movable transversely with respect to the longitudinal direction of the process valve duct 3. In the state according to FIG. 1, the process valve duct 3 and the throughflow opening 6 in the process valve slide 5 do not overlap. The process valve is therefore closed. In one state (not illustrated), the throughflow opening 6 and the process valve duct 3 overlap to a substantial extent. The process valve is almost fully open.

A process valve of the type shown and of the use described is intended, on the one hand, to be able to be actuated in a controlled manner, and on the other hand, to contribute to safety too in that, in the event of a fault, said process valve quickly and reliably assumes a position which corresponds to a safe state. In the present case, said safe state is a closed process valve.

The process valve 1 is actuated by a compact electrohydraulic system 7, which is arranged under water directly on the process valve 1. It is sufficient for merely one electrical cable 8 to lead to the surface of the sea, or to some other higher-level electrical controller situated under water, from the electrohydraulic system 7.

The electrohydraulic system 7 shown as an exemplary embodiment has a container 9 which is fastened on an open side to the process valve housing 2 such that an inner space 10 which is closed off with respect to the surroundings and which is filled with a hydraulic pressurized fluid as working medium is present. For the fastening to the process valve housing 2, the container 9 has on its open side an inner flange by way of which it is screwed to the process valve housing 2. Radially outside the screw connections, between the inner flange of the container 9 and the process valve housing 2, there is arranged a peripheral seal 11, which is inserted into a peripheral groove of the process valve housing 2.

The container 9 is pressure-compensated with respect to the ambient pressure (seawater region 66) prevailing under water. For this purpose, at a pressure compensator 67, a cover 15 is fastened with a flange 14 onto a flat edge 13 which surrounds an opening 12 in the container wall, and a diaphragm 16 is clamped in in a leak-tight manner between the flat edge 13 and the cover 15. Holes 17 are present in the cover 15, with the result that the space between the diaphragm 16 and the cover 15 is part of the surroundings and is filled with seawater. The inner space 10 is therefore sealed off with respect to the surroundings by the diaphragm 16. The diaphragm 16 is subjected at its first surface, which faces the inner space 10, to the pressure in the inner space 10 and at its second surface, which faces the cover 15 and is approximately the same size as the first surface, to the pressure which prevails in the surroundings, and always seeks to assume a position and shape in which the sum of all the forces acting on it is zero. In order for the pressure in the inner space 10 to be slightly higher than the ambient pressure, the diaphragm 16, in addition to the ambient pressure, is also acted upon by a spring 18 counter to the inner pressure, said spring being clamped in between a dimensionally stable central diaphragm plate 19 and the cover 15. The force of the spring 18, with the size of the surfaces of the diaphragm 16 that are subjected to pressure taken into consideration, is selected such that the pressure in the inner space is for example 0.5 bar to 2 bar higher than the ambient pressure. A rod 20 is fastened to the diaphragm plate 19 and is guided in the cover 15 and is provided with a solid measure and may be part of a detector which detects the position of the center of the diaphragm 16. A rod provided with a solid measure may also project from the diaphragm plate 19 into the inner space 10 in order to interact there with a distance sensor. It is then the case that contact with seawater is avoided, and reliability is increased.

All the mechanical, electrical and hydraulic components which are necessary or advantageous for the control of the process valve 1 are, with the exception of the source of the electrical power energy and of higher-level electrical control signals, accommodated in the inner space 10 of the container 9.

There, there is firstly a hydraulic cylinder 21 having a cylinder housing 22 which is closed off at end sides by a cylinder base 23 and a cylinder head 24, having a piston 25 which is displaceable in the interior of the cylinder housing 22 in the longitudinal direction of the cylinder housing 22, and having a first piston rod 26 which is fixedly connected to the piston 25 and projects away from the piston 25 on one side and passes in a sealed manner and (in a way not illustrated in more detail) in a guided manner through the cylinder head 24. The gap 24 between the piston rod 26 and the cylinder head 24 is sealed off by two seals 28 arranged in the cylinder head 24 axially spaced apart from one another. The process valve slide 5 is attached to the free end of the piston rod 26. Furthermore, provision is made of a second piston rod 27, which is fixedly connected to the piston 25 and projects away from the piston 25 to the other side and is guided in a sealed-off manner and passes through the cylinder base 23. The interior of the cylinder housing 22 is subdivided by the piston 25 into a cylinder head-side first cylinder chamber 29 and into a base-side second cylinder chamber 30, the volumes of which depend on the position of the piston 25.

Figure 1A:
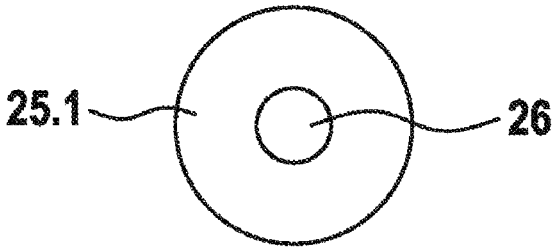
FIG. 1*a* shows a plan view of the first active surface of the piston.
Figure 1B:
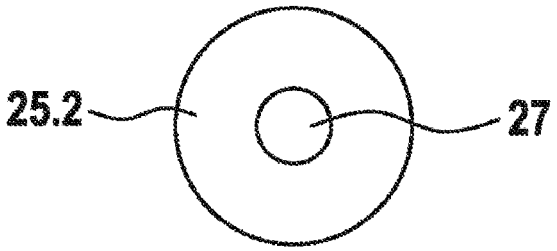
FIG. 1*b* shows a plan view of the second active surface of the piston.

FIG. 1*a* illustrates the first active surface 25.1 of the piston 25 on the side of the first cylinder chamber 29 by way of a cross section through the first piston rod 26. FIG. 1*b* illustrates the second active surface 25.2 of the piston 25 on the side of the second cylinder chamber 30 by way of a cross section through the second piston rod 27. The two substantially circular ring-shaped active surfaces 25.1 and 25.2 are the same size in the exemplary embodiment.

A helical compression spring 31 is accommodated in the first cylinder chamber 29 and surrounds the piston rod 26 and is clamped in between the cylinder head 24 and the piston 25, that is to say acts on the piston 25 in a direction in which the piston rod 26 is retracted and the process valve slide 5 is moved for closing the process valve 1.

A hydrostatic hydraulic machine 32, which is operable both as a pump and as a hydraulic motor, and an electric machine 33, which is mechanically coupled to the hydraulic machine 32 for a common rotating movement and is operable both as an electric motor and as a generator, are also situated in the inner space 10 of the container 9. The hydraulic machine 32 has a pressure port 34 and a suction port 35 which is open toward the inner space 10. The hydraulic machine 32 is adjustable from positive swept volumes to negative swept volumes via a zero position, in which the swept volume is zero, such that it is operable as a pump or as hydraulic motor in the same rotation direction and by way of the same pressure port. A positive swept volume is in this case correlated with the operation as a pump. The electric machine 33 is able to be regulated in terms of its rotational speed and, for this purpose, is connected to an electrical control unit 36, which is likewise accommodated in the inner space 10 and connected to an electrical energy source on the surface of the sea, or to a higher-level electrical controller arranged under water, via the cable 8 which is led in a sealed-off manner out of the container 10. The rotational speed of the hydraulic machine and the electric machine is detected by a rotational speed detector 37 and is processed by the control unit 36.

Pressurized fluid sucked in from the inner space 10 can be conveyed by the hydraulic machine 32, during operation as a pump, to the cylinder chamber 30 via the pressure port 34. Conversely, pressurized fluid can be displaced from the cylinder chamber 30 into the inner space 10 of the container 9 via the hydraulic machine 32. In this sense, the cylinder chamber 30 is the second cylinder chamber in the exemplary embodiment. A 2/2 directional seat valve 38 situated in the inner space is inserted into the connection between the hydraulic machine 32 and the cylinder chamber 30 and, in a rest position, which it assumes under the action of a spring 39, is open, and in a switched position, into which it can be brought by an electromagnet 40, prevents a flow of pressurized medium from the cylinder chamber 30. The 2/2 directional seat valve 38 is a safety-relevant valve and is arranged such that, in the event of a power failure of the electromagnet 40, the valve opens due to the spring 39 and the second cylinder chamber 30 of the hydraulic cylinder 21 is emptied, with the result that the helical compression spring 31 of the hydraulic cylinder 21 can move this back.

A 2/2 directional seat valve 41 which, by way of one port, is connected to the first cylinder chamber 29 and, by way of the other port, is open toward the inner space 10 is also situated in the inner space 10. The valve 41 assumes under the action of a spring 42 a rest position in which the cylinder chamber 29 is blocked with respect to an outflow of pressurized medium into the inner space 10, and can be brought by an electromagnet 43 into a switched position in which there is an open connection between the cylinder chamber 29 and the inner space 10.

A hydraulic accumulator 44 is also situated in the inner space 10 and has a cylindrical accumulator housing 47 which is open toward the inner space 10 on one end side and which is sealed off by a base 46 on the other end side, has an accumulator piston 47 which is movable in an axial direction of the accumulator housing 45, and has a compression spring 48 which is clamped in between the accumulator piston 47 and a stop on the open side of the accumulator housing 45. Formed between the base 46 and the accumulator piston 47 is a pressurized-fluid space 49 whose volume depends on the position of the accumulator piston 47. This is therefore acted on in the direction of an increase of the volume of the pressurized-fluid space 49 by a force generated by the pressure in the pressurized-fluid space 49, and in the opposite direction by a force generated by the pressure in the inner space 10 and by the force of the compression spring 48.

The pressurized-fluid space 49 is able to be fed pressurized medium from the hydraulic machine 32, during operation as a pump, via a valve 50 situated in the inner space 10.

The valve 50 allows no pressurized medium in the direction from the pressurized-fluid space 49 to the hydraulic machine 32. If the pressure space is otherwise blocked, the accumulator piston 47 in this case moves in the sense of an enlargement of the pressure space, with the compression spring 48 being tensioned with greater intensity, the force of the compression string increasing and the accumulator pressure in the pressure space thus increasing beyond the pressure in the inner space 10. As a result of the characteristic curve for the compression spring 48 being known, each position of the accumulator piston 47 corresponds to a specific pressure in the pressurized-fluid space 49. An end position of the accumulator piston 47 and thus the desired maximum accumulator pressure are able to be detected by a position detector 51. The attainment of the maximum accumulator pressure results in the valve 50 being blocked, as is indicated by the dashed line leading from the position detector 51 to the valve 50. For the purpose of detecting the accumulator pressure, use may also be made of an electromechanical pressure sensor.

Via a 2/2 directional seat valve 52 situated in the inner space 10, the pressurized-fluid space 49 of the hydraulic accumulator 44 can be fluidically connected to the first cylinder chamber 29 and be blocked with respect to the cylinder chamber 29. The valve 50 assumes under the action of a spring 53 a rest position in which there is an open connection between the cylinder chamber 29 and the pressurized-fluid space 49, and can be brought by an electromagnet 54 into a switched position in which the cylinder chamber 29 is blocked with respect to an inflow of pressurized medium from the pressurized-fluid space 49.

The valves 38, 41 and 52 may be equipped with sensors for position monitoring for the purpose of immediate detection of an erroneous function by the electrical controller.

The pressurized-fluid space 49 is connected via a line 55 to a region on the cylinder head 24 that is situated axially between the two seals 28. Consequently, in the case of a charged hydraulic accumulator 44, the pressure difference at the outer seal 28, specifically the difference between the pressure of the conveyed medium in the process valve 1, which prevails on one side of the outer seal 28, and the pressure on the other side of said seal is less than the difference between the pressure of the conveyed medium and the pressure in the inner space 10, with the result that leakage is reduced too.

As further valves, a pressure-limiting valve 56, which is connected to the pressure port 34 of the hydraulic machine 32, and a suction valve 57, in the form of a check valve which is arranged in a bypass between the suction port 35 and the pressure port 34 and which opens from the suction port 35 toward the pressure port 34, are also present. The suction valve 57 prevents cavitation at the hydraulic machine 32, if the latter is operated as a motor and the cylinder chamber has been completely emptied or the valve 38 closes.

In addition to the sensors already mentioned hitherto, in the exemplary embodiment shown, three position sensors 58 are furthermore provided, by way of which position sensors specific positions of the piston 25 and thus the piston rods 26, 27 can be detected. It may also be the case that just one sensor is present, said sensor continuously detecting the positions of the piston 25 and a piston rod 26 or 27.

As compared with the exemplary embodiment shown, modifications of an electrohydraulic system 7 according to the disclosure are also possible.

The electrical controller comprises in the simplest form a DC motor, an electrical control device having corresponding analog and digital input and output interfaces, and a suitable power supply.

State monitoring for the electrohydraulic system 7 is able to be implemented in the electrical controller in that all the sensor signals are evaluated by way of corresponding algorithms converted into software form. In the event of a fault, the controller is able to bring the hydraulic cylinder 21 into the safe rest position autonomously and to inform the higher-level controller. To this end, preventive and reactive maintenance measures can be communicated to the higher-level controller.

Figure 2:
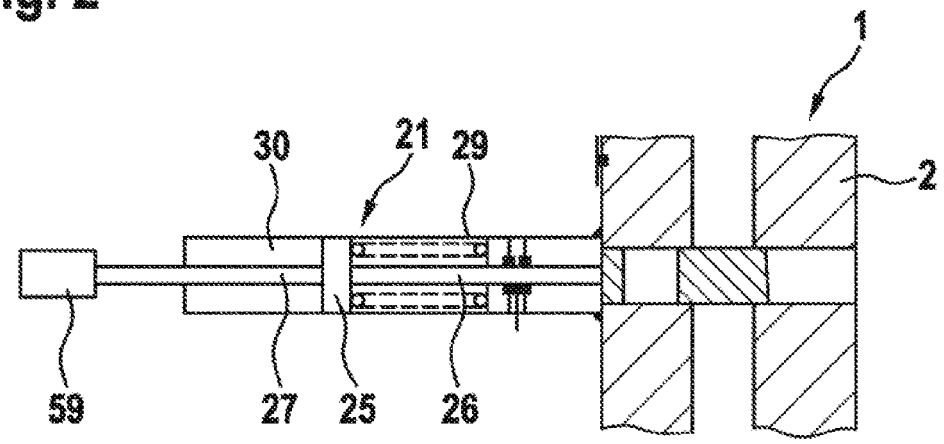
FIG. 2 shows, on a reduced scale, a detail of the device as per FIG. 1, albeit with an additional vacuum chamber.

FIG. 2 illustrates, on a reduced scale, a detail of the device as per FIG. 1, albeit with an additional cylinder chamber 59, which is subjected to vacuum or negative pressure. The cylinder chamber 59 is associated with the second piston rod 27. The cylinder chamber 59 serves for compensating for the actuation volume of the actuating actuating drive. Compensation of the surface of the retracting piston rod, for example by the vacuum bushing or vacuum sleeve, results in there being no net compensation requirement.

Figure 3:
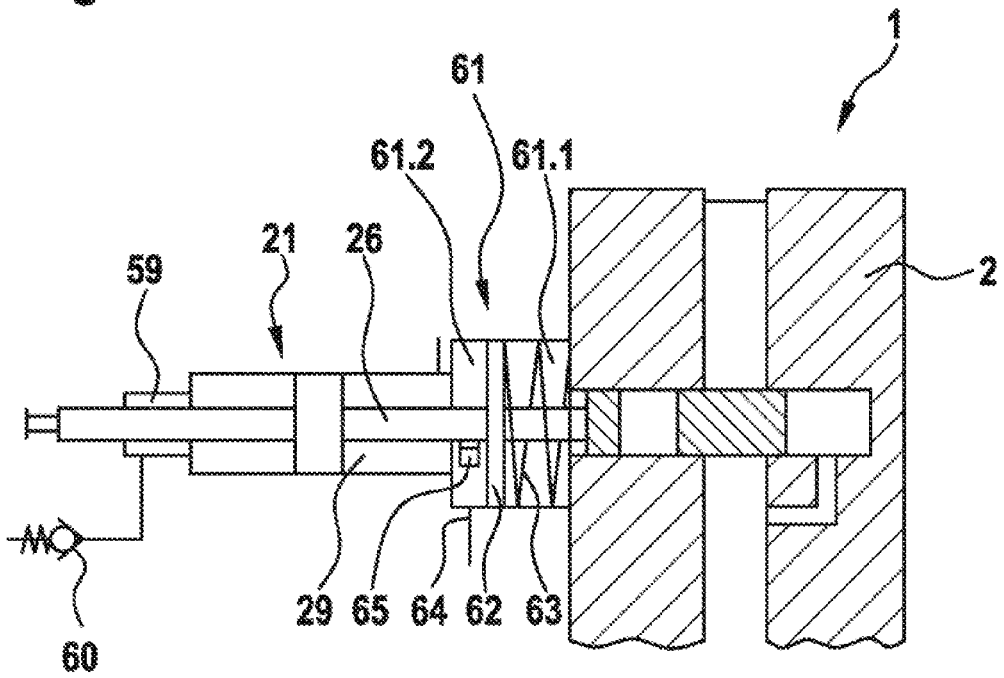
FIG. 3 shows a detail of the device as per FIG. 1, albeit with an additional cylinder housing with a pressure piston and with a compression spring.
Figure 3A:
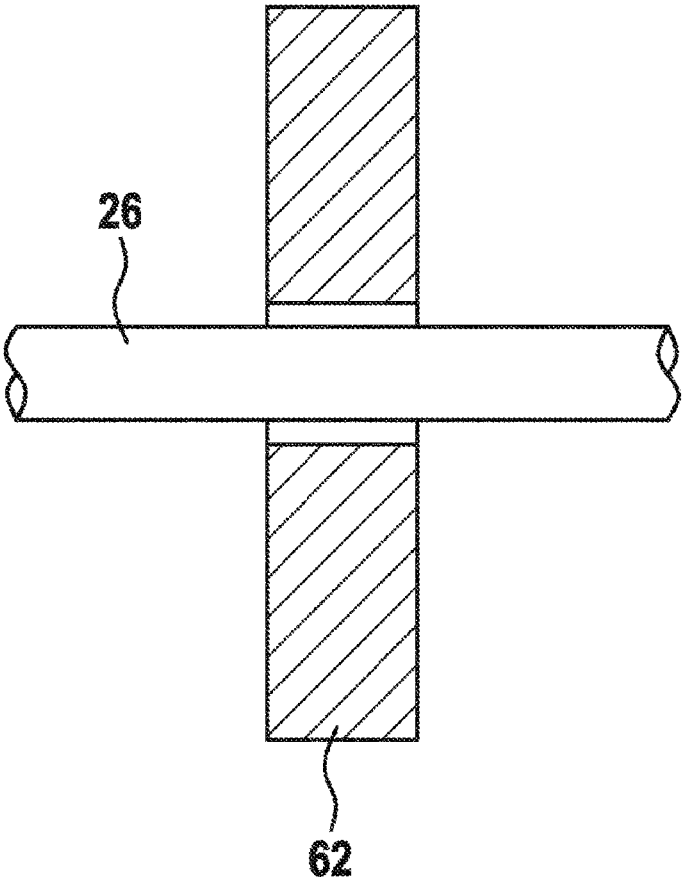
FIG. 3*a* shows, on an enlarged scale, the pressure piston in section and the first piston rod as per FIG. 3.

FIG. 3 shows a detail of the device as per FIG. 1 without a helical compression spring 31, albeit with an additional cylinder housing 61 which is arranged between the first cylinder chamber 29 of the hydraulic cylinder 21 and the process valve housing 2. A pressure piston 62 subdivides the interior of the sealed-off cylinder housing 61 into a first housing chamber 61.1 and into a second housing chamber 61.2. The pressure piston 62 is mounted slidingly on the first piston rod 26, which passes in a sealed-off manner through the cylinder housing 61 (see FIG. 3*a*). Consequently, the first piston rod 26 likewise passes through the pressure piston 62. A compression spring 63 in the first housing chamber 61.1 is supported at one end thereof against the pressure piston 62 and at the other end thereof against an inner wall of the first housing chamber 61.1 or an outer wall of the process valve housing 2.

A working port 64 for the inflow and outflow of hydraulic fluid is present at the second housing chamber 61.2 and is connected for example to a hydraulic pump (not illustrated). Via an inflow through the working port 64, firstly pressure is built up in the second housing chamber 61.2. This results in the pressure piston 62 being displaced—to the right in FIG. 3—and the compression spring 63 being tensioned. The displacement of the pressure piston 62 is realized slidingly on the first piston rod 26 passing therethrough; a "flying" pressure piston 62 is present. If the pressure in the first cylinder chamber 29 of the hydraulic cylinder 21 is not sufficiently high for a reverse movement of the piston 25—to the left in FIG. 3, the pressure in the second housing chamber 61.2 is reduced by outflow of pressurized fluid through the working port 64, for example into a tank. This results in relaxation of the compression spring 63, with the result that the pressure piston 62 is displaced—to the left in FIG. 3. Within the second housing chamber 61.2, a carrier element 65, for example stop, shoulder, annular flange, is situated on the first piston rod 26 and rigidly connected or fastened to the latter, the pressure piston 62 coming into engagement with, and exerting pressure on, said carrier element. Consequently, the first piston rod 26 is simultaneously displaced—to the left in FIG. 3. In this way, in the case of reduced hydraulic pressure in the first cylinder chamber 29, a withdrawal movement of the piston 25 is realized in a mechanical manner.

A safety valve, as illustrated in FIG. 1 at the positions 38, 39 and 40, is inserted in the working port 64 between a hydraulic pump (not illustrated) and the second housing chamber 61.2. In the event of a power failure of the electromagnet 40, the valve opens due to the spring 39. The second housing chamber 61.2 is emptied due to the force of the compression spring 63 against the pressure piston 62, and the process valve 1 is closed.

The additional cylinder chamber 59 is assigned a check valve 60. Should a leak be present in the seal of the cylinder chamber 59, and hydraulic fluid, for example oil, enters the vacuum chamber, the hydraulic fluid is pushed out by way of the next withdrawal movement of the piston 25 and, in this way, the cylinder chamber 59 is freed of the oil. The check valve 60, with a pressure reduction, thus makes it possible for leakage oil accumulated in the inner space of the cylinder chamber 59 (vacuum chamber) to be emptied again when the piston 25 is moved, that is to say for the low pressure to be re-established at each drive cycle.

LIST OF REFERENCE SIGNS

1 Process valve
2 Process valve housing
3 Process valve duct
4 Arrow
5 Process valve slide
6 Throughflow opening
7 Electrohydraulic system
8 Cable
9 Container
10 Inner space of 9
11 Seal
12 Opening in 9
13 Flat edge
14 Flange
15 Cover
16 Diaphragm
17 Holes in 15
18 Spring
19 Diaphragm plate
20 Rod
21 Hydraulic cylinder
22 Cylinder housing
23 Cylinder base
24 Cylinder head
25 Piston
25.1 First active surface of 25
25.2 Second active surface of 25
26 First piston rod
27 Second piston rod
28 Seals
29 First cylinder chamber
30 Second cylinder chamber
31 Helical compression spring
32 Hydraulic machine
33 Electric machine
34 Pressure port
35 Suction port
36 Electrical control unit
37 Rotational speed detector
38 2/2 directional seat valve
39 Spring
40 Electromagnet
41 2/2 directional seat valve
42 Spring
43 Electromagnet
44 Hydraulic accumulator
45 Accumulator housing
46 Base
47 Accumulator piston
48 Compression spring
49 Pressurized-fluid space
50 Valve
51 Position detector
52 2/2 directional seat valve
53 Spring
54 Electromagnet
55 Line
56 Pressure-limiting valve
57 Suction valve
58 Position sensor
59 Additional cylinder chamber
60 Check valve
61 Additional cylinder housing
61.1 First housing chamber
61.2 Second housing chamber
62 Pressure piston
63 Compression spring
64 Working port
65 Carrier element
66 Seawater region
67 Pressure compensator

The invention claimed is:

1. An electrohydraulic system for use under water, comprising:

an electrohydraulic actuating drive;

a container that defines an inner space, the inner space forming a volume which is sealed off with respect to the surroundings and which is flooded with a hydraulic fluid;

a hydraulic cylinder arranged in the hydraulic fluid;

a piston to which a first piston rod and a second piston rod are connected, the piston subdividing an interior of the hydraulic cylinder into a first cylinder chamber and a second cylinder chamber, the piston having two active surfaces that are the same size an additional cylinder housing; and a pressure piston that subdivides an interior of the cylinder housing into a first housing chamber and a second housing chamber, wherein the pressure piston is mounted slidingly on the first piston rod.

2. The electrohydraulic system as claimed in claim 1, further comprising:

an additional cylinder chamber configured to compensate for volume flow of the hydraulic cylinder to be actuated, the additional cylinder chamber subjected to vacuum or negative pressure generated by movement of the second piston rod.

3. The electrohydraulic system as claimed in claim 2, wherein the additional cylinder chamber receives at least a portion of the second piston rod.

4. The electrohydraulic system as claimed in claim 2, wherein the additional cylinder chamber is one of a vacuum bushing and a vacuum sleeve.

5. The electrohydraulic system as claimed in claim 1, further comprising:

a carrier element fastened to the first piston rod within the second housing chamber.

6. The electrohydraulic system as claimed in claim 1, further comprising:

a compression spring arranged in the first housing chamber and supported at a first end against the pressure piston and at a second opposite end against the first housing chamber or a process valve housing.

7. The electrohydraulic system as claimed in claim 1, further comprising:

a pressure compensator configured to subject the hydraulic fluid in the inner space at least approximately to a pressure which prevails outside the container.

8. The electrohydraulic system as claimed in claim 1, further comprising:

a 2/2 directional seat valve, with an electromagnet and a spring, inserted into a connection between a hydraulic machine and the second cylinder chamber.

9. An electrohydraulic system for use under water, comprising:

an electrohydraulic actuating drive;

a container that defines an inner space, the inner space forming a volume which is sealed off with respect to the surroundings and which is flooded with a hydraulic fluid;

a hydraulic cylinder arranged in the hydraulic fluid;

a piston to which a first piston rod and a second piston rod are connected, the piston subdividing an interior of the hydraulic cylinder into a first cylinder chamber and a second cylinder chamber, the piston having two active surfaces that are the same size;

an additional cylinder chamber configured to compensate for volume flow of the hydraulic cylinder to be actuated, the additional cylinder chamber subjected to vacuum or negative pressure generated by movement of the second piston rod; and a check valve operably connected to the additional cylinder chamber.

10. The electrohydraulic system as claimed in claim 9, further comprising:

an additional cylinder housing; and a pressure piston that subdivides an interior of the cylinder housing into a first housing chamber and a second housing chamber.

11. An electrohydraulic system for use under water, comprising:

an electrohydraulic actuating drive;

a container that defines an inner space provided for forming a volume which is sealed off with respect to the surroundings and which is configured to receive a hydraulic pressurized fluid;

a hydraulic cylinder arranged in the inner space of the container;

a piston to which a first piston rod and a second piston rod are connected, the piston subdividing an interior of the hydraulic cylinder into a first cylinder chamber and a second cylinder chamber, the piston having two active surfaces that are the same size:

an additional cylinder chamber configured to compensate for volume flow of the hydraulic cylinder to be actuated, the additional cylinder chamber subjected to vacuum or negative pressure; and a check valve assigned to the additional cylinder chamber.

* * * * *